US007074134B2

(12) United States Patent
Piche

(10) Patent No.: US 7,074,134 B2
(45) Date of Patent: Jul. 11, 2006

(54) PUTTING TRAINER

(75) Inventor: Mario Piche, Calgary (CA)

(73) Assignee: Sterling Holdings Corporation, Calgary (CA)

( * ) Notice: Subject to any disclaimer, the term of this patent is extended or adjusted under 35 U.S.C. 154(b) by 0 days.

(21) Appl. No.: 10/905,665

(22) Filed: Jan. 14, 2005

(65) Prior Publication Data

US 2005/0159233 A1 Jul. 21, 2005

Related U.S. Application Data

(60) Provisional application No. 60/536,534, filed on Jan. 15, 2004.

(51) Int. Cl.
*A63B 69/36* (2006.01)

(52) U.S. Cl. ..... 473/265; 473/226; 473/257; 473/258

(58) Field of Classification Search ..... 473/219, 473/226–229, 257–265
See application file for complete search history.

(56) References Cited

U.S. PATENT DOCUMENTS

| | | | |
|---|---|---|---|
| 1,545,648 | A | 7/1925 | Fletcher |
| 1,644,392 | A | 10/1927 | Meyers |
| 2,084,902 | A | 6/1937 | Eisenberg |
| 2,303,736 | A | 12/1942 | Hall |
| 2,723,858 | A | 11/1955 | Chizewski |
| 3,073,602 | A | 1/1963 | Bell |
| 3,104,108 | A | 9/1963 | Robertson |
| 3,471,155 | A | 10/1969 | Donaldson |
| 3,844,569 | A | 10/1974 | Swanson |
| 3,885,796 | A | 5/1975 | King |
| 3,934,874 | A | 1/1976 | Henderson |
| D244,874 | S | 6/1977 | Lombardi |
| 4,111,426 | A | 9/1978 | Goodwin |
| 4,133,535 | A | 1/1979 | Marsh |
| 4,153,255 | A | 5/1979 | Woodson |
| 4,315,626 | A | 2/1982 | Hamm |
| 4,334,684 | A | 6/1982 | Sterling |
| 4,437,669 | A | 3/1984 | Pelz |
| 4,647,045 | A | 3/1987 | Bilyeu |
| 4,805,912 | A | 2/1989 | Hickman |
| 5,011,153 | A | 4/1991 | Watkins |
| 5,014,994 | A | 5/1991 | Peters |
| 5,072,943 | A | 12/1991 | Sindelar |

(Continued)

FOREIGN PATENT DOCUMENTS

| | | |
|---|---|---|
| JP | 04-281565 | 4/1995 |

(Continued)

OTHER PUBLICATIONS

Golfsmith Putting Track www.dwquailgolf.com/training/golfsmith_ptg_trk.html.

(Continued)

*Primary Examiner*—Nini F. Legesse
(74) *Attorney, Agent, or Firm*—Sean W Goodwin; Linda M Thompson

(57) ABSTRACT

A training device for a putting stroke in the game of golf. A base and sidewalls form a track which defines the path of the stroke. A guide attached to the putter head fits within the track and prevents the putter head from binding in the track and thus directs the putter head along the track causing the golfer to keep proper wrist alignment and to build muscle memory when properly stroking the ball. One version of the track permits the width of the track to be adjusted to accommodate putters having different sized heads. Further, a portion of the track may be adjusted to train a putting stoke having a slightly curved backswing.

22 Claims, 14 Drawing Sheets

U.S. PATENT DOCUMENTS 5,125,844 A 6/1992 Grant et al.
5,152,534 A 10/1992 Sindelar
5,246,233 A 9/1993 Sheltman et al.
5,332,211 A 7/1994 Rife et al.
5,435,547 A 7/1995 Lee
5,437,458 A 8/1995 Springer
5,476,262 A 12/1995 Bandiero
5,501,462 A 3/1996 Shih
5,527,041 A 6/1996 Terry, III et al.
5,551,695 A 9/1996 Wolk
5,551,924 A 9/1996 Zumtobel
5,586,941 A 12/1996 Klearman
5,595,543 A 1/1997 Wolk
5,658,204 A 8/1997 Nappi
5,716,286 A 2/1998 Swan
5,769,736 A 6/1998 Sato
5,797,804 A 8/1998 Chen
5,827,125 A 10/1998 Lee
5,919,096 A 7/1999 Kim
6,019,685 A * 2/2000 Fonseca et al. ..... 473/265
6,129,639 A 10/2000 Brock et al.
6,159,106 A 12/2000 Adams
6,270,422 B1 8/2001 Fisher
6,443,852 B1 9/2002 Kim
6,458,039 B1 10/2002 Fontes
6,461,246 B1 10/2002 Lee et al.
6,461,247 B1 10/2002 Riddell
6,464,596 B1 10/2002 Belding
6,561,920 B1 5/2003 Hamilton
6,616,541 B1 9/2003 Michelizza
6,623,371 B1 9/2003 Corcoran
6,837,802 B1 * 1/2005 Santamaria ..... 473/258

FOREIGN PATENT DOCUMENTS

WO WO 03/063971 A1 8/2003

OTHER PUBLICATIONS

High Tech Putting Track www.dwquailgolf.com/training/high_tech_putting_track.html.
Plexi Putting Track www.dwquailgolf.com/training/plexi_putting_track.html.
Putting Rail www.dwquailgolf.com/training/putting_rail.html.
PuttRich www.dwquailgolf.com/training/puttrich.html.

* cited by examiner

PUTTING TRAINER

CROSS REFERENCE TO RELATED APPLICATION

This application claims priority of U.S. Provisional Patent application Ser. No. 60/536,534 filed Jan. 15, 2004, the entirety of which is incorporated herein by reference.

FIELD OF THE INVENTION

Embodiments of the invention relate to training a golfer's putting stroke and more particularly to apparatus used for same.

BACKGROUND OF THE INVENTION

Putting is an essential skill for golfer's, both recreational and professional. A number of strokes can be subtracted from a player's score if the player is able to consistently control their putting stroke.

It is known to train an athlete to perform a skill, such as a golfer's putting stroke, by building the "muscle memory" as a result of repetitively performing the skill in a correct or desired manner. In order to ensure that this repetitive training is effective, apparatus have been developed to assist in maintaining a proper stroke.

A number of prior art devices are known to assist a golfer to develop a consistent putting stroke. Many of these devices are merely visual aids to assist in alignment of the putter head with the ball and do not force the stroke to follow a pattern throughout the backswing and the follow through.

A number of known devices provide a track in which the golfer can stroke the putter head, the putter being either fixed to the track in some fashion or free within the track. One such prior art device is that taught in U.S. Pat. No. 5,595,542 to Walk which provides a putting track and two L-shaped attachment deflection members having two adjustable guide pointers removably attached to a conventional putter. The attachment members and the track provide a visual indicator of alignment rather than forcing the putter head to remain in alignment. Further, golfer's wrists are not caused to remain stable throughout the stroke and therefore to follow a consistent pattern throughout the stroke, techniques many believe to be elements of a consistent putting stroke.

U.S. Pat. No. 3,471,155 to Donaldson teaches a track and a carriage means used to clamp the putter head within the track.

U.S. Pat. No. 3,885,796 to King teaches a track and a specially designed rectangular putter head, which is adjustably connected to a shaft and freely moveable within the track, to approximate the adjustment of the head and shaft to that of the golfer's putter. The rectangular shape of the head is particular to provide contact between the track and the head, should the swing not follow the track. The point of contact of the head with the track is relatively small and Applicant believes that the head has an increased tendency to bind within the track and to stop an incorrect stroke rather than forcing the stroke to match the track on a consistent basis.

Clearly there is a need for a simple device that permits a golfer to use the putter that they will use on the golf course, that can be used without the need to affix the putter to the device and that will force the golfer to stroke the ball, according to a predetermined optimal stroke, in both the backswing and follow-through portions of the stroke.

SUMMARY OF THE INVENTION

Apparatus for training a putting stroke in the game of golf comprises a track in which a putter is stroked and a guide, sized to the width of the track, which is attached to the putter for directing a head of the putter along a path defined by the track. The putter is freely moveable within the track. The guide attached to the putter acts not only to direct the head of the putter but also to increase the effective axial extent of the putter head preventing the putter head from twisting and binding in the track. Thus, a golfer using the apparatus is directed to maintain a proper wrist positioning and builds muscle memory while stroking the putter head and guide from a backswing through a target point, typically a golf ball, to a follow-through portion of the swing.

In a broad aspect of the invention, apparatus for training a golfing stroke using a putter comprises a base; substantially parallel sidewalls connected to the base and spaced a width apart for forming a track therebetween, the track being adapted for releasably accepting a putter head for free axial movement therealong in a path; and a guide adapted to be releasably connected to the putter to reside in the track, sized to be substantially the width between the sidewalls and having an effective axial extent, wherein, in the track, the guide maintains the putter head substantially perpendicular to the sidewalls and directs the stroke when moved axially therein along the path for stroking through a target point.

Preferably, the side walls are adjustable connected to the base such as by fasteners and slots, permitting the width of the track to be adjusted or optionally, a portion of the path to be altered, such as a slightly curved backswing portion.

Preferably, the base is open at a front end of the apparatus to permit the ball to be placed and stroked to run along the surface on which the base is placed preventing alterations in the flight of the ball which might result from a transition between the base and the surface. More preferably, a narrow U-shaped opening extends contiguous to the base opening for assisting in centering the ball in the track.

Optionally, the apparatus is provided with ball supply means. In a preferred embodiment the ball supply means is an angled, ramped trough extending along a sidewall and terminating at an entrance in the sidewall which permits the balls to enter the track. Preferably the entrance is adjacent the termination of the U-shaped opening which receives and centers the balls as they enter the track.

Preferably a user-actuated mechanism or gate means permits electively releasing the golf balls from the trough to the track. In one embodiment, the gate means is a finger which is pivotally connected to the sidewall and is normally biased to protrude across a portion of the entrance. Pressure applied to a portion of the finger overcomes the biasing means, such as springs, and temporarily pivots the finger away from the entrance permitting a ball to enter the track.

In an alternate embodiment, the gate means comprises an L-shaped plate which forms a back wall to the track and extends along the sidewall and is moveably connected thereto using fasteners and slots, the plate being normally biased to extend over the entrance. Pressure applied to the back wall using the putter temporarily overcomes the biasing means, such as springs or elastic bands, and permits a ball to enter the track.

DETAILED DESCRIPTION OF THE PREFERRED EMBODIMENT

Having reference to FIGS. 1–10, embodiments of apparatus for training a putting stroke for golfing are shown.

Figure 1:
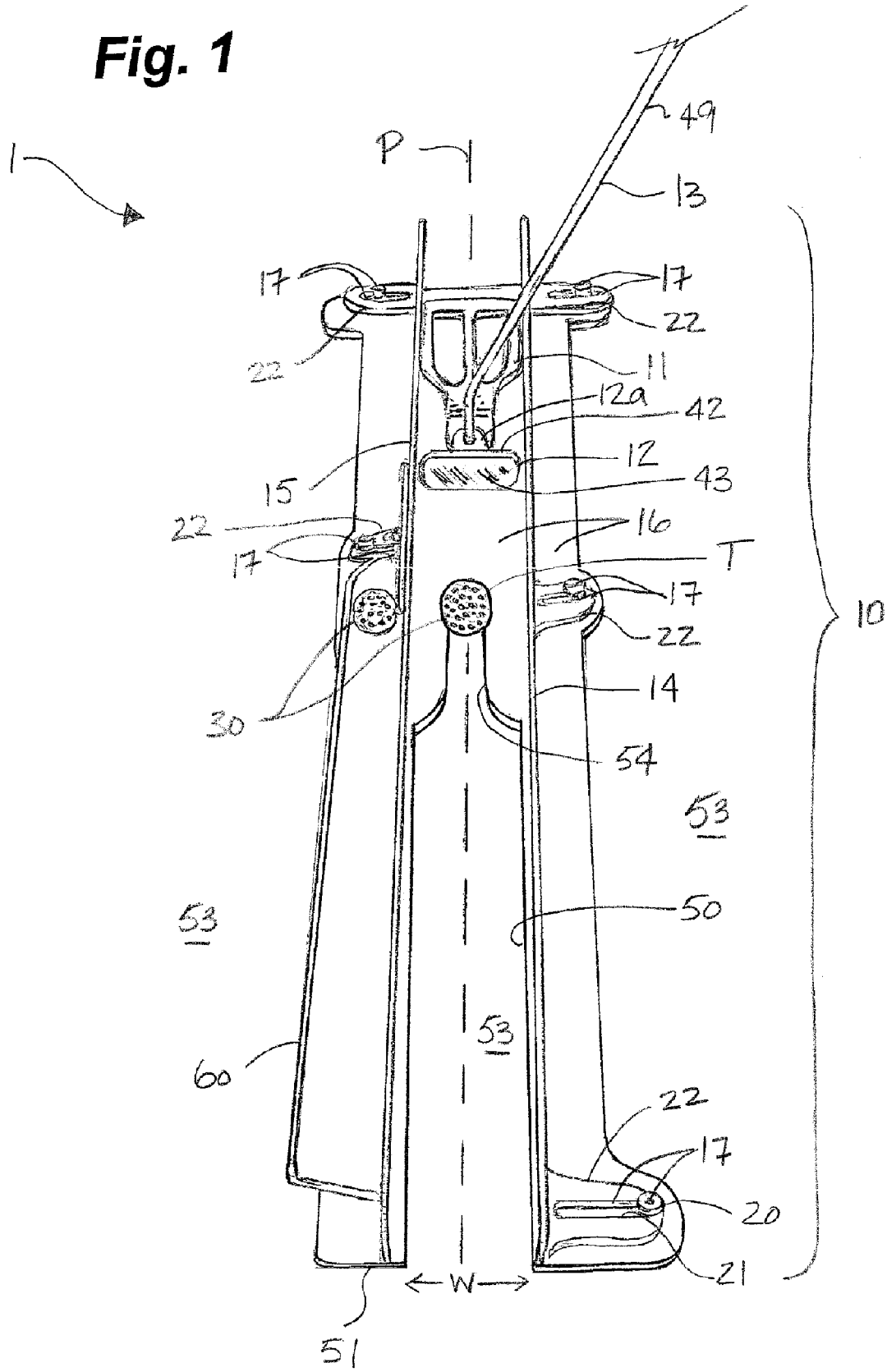
FIG. 1 is a perspective end view of an embodiment of the invention having an adjustable width track, a guide adapted for lagging attachment to a putter head and sized for the track, and a ball supply trough for feeding a supply of balls into the track.

Having particular reference to FIG. 1, a putting trainer 1 comprises a track 10 for limiting the putting stroke to follow a pre-determined pattern or path P and a guide 11 adapted to be positioned adjacent a head 12 of a putter 13 and sized substantially the same as a width W of the track 10. The guide 11 ensures that the putter head 12 remains substantially perpendicular to substantially parallel sidewalls 14,15, which are spaced apart and attached to a base 16 to form the track 10. Further, the guide 11 ensures the putter head and attached guide 12,11 do not bind within the track 10. Thus, the putter head 12 is directed along the path P established by the track 10 and the golfer is forced to maintain proper putter head 12 positioning and wrist alignment in order to complete the putting stroke therein. In FIG. 1, a linear path P is shown.

In an embodiment as shown in FIGS. 1–5, the base 16 is separate from the sidewalls 14,15. The sidewalls 14,15 are connected to the base 16 by a plurality of adjustable connection means 17 which permit altering the width W or the path P of the track Should the track width W be adjusted to accommodate an unusual sized putter head 12, a corresponding adjustment is made to a width of the guide 11 to be used. Different sized guides 11 may be provided, or alternatively, a guide (not shown) having an adjustable width may be provided to ensure that the putter head 12 cannot twist or bind within the track 10.

Some of the plurality of connection means 17, such as those along at least one sidewall 14,15, may be adjusted to permit movement of the at least one sidewall 14,15, relative to the base 16, to widen the track 10. At least some of the plurality of connection means 17, such as those adjacent both sidewalls 14,15 adjacent a portion of the track 10 can be adjusted, relative to the remainder of the connections means 17, and both sidewalls 14,15 can be moved relative to the base 16, in parallel arrangement, to adjust the path P.

In one embodiment, the connection means 17 are co-operating fasteners 20 and slots 21. The fasteners 20, such as wing nuts or the like, extend upwards from the base 16 through the slots 21 which extend from the sidewalls 14,15, preferably formed in tabs 22 which extend and overly the base 16. To adjust the width W of the track 10, at least some of the fasteners 20 are loosened to permit movement of one or both of the sidewalls 14,15 and then tightened to fix the position of the sidewalls 14,15 relative to each other and to the base 16. The slots 21 typically have a fixed length to limit the degree of adjustment possible.

Figure 2:
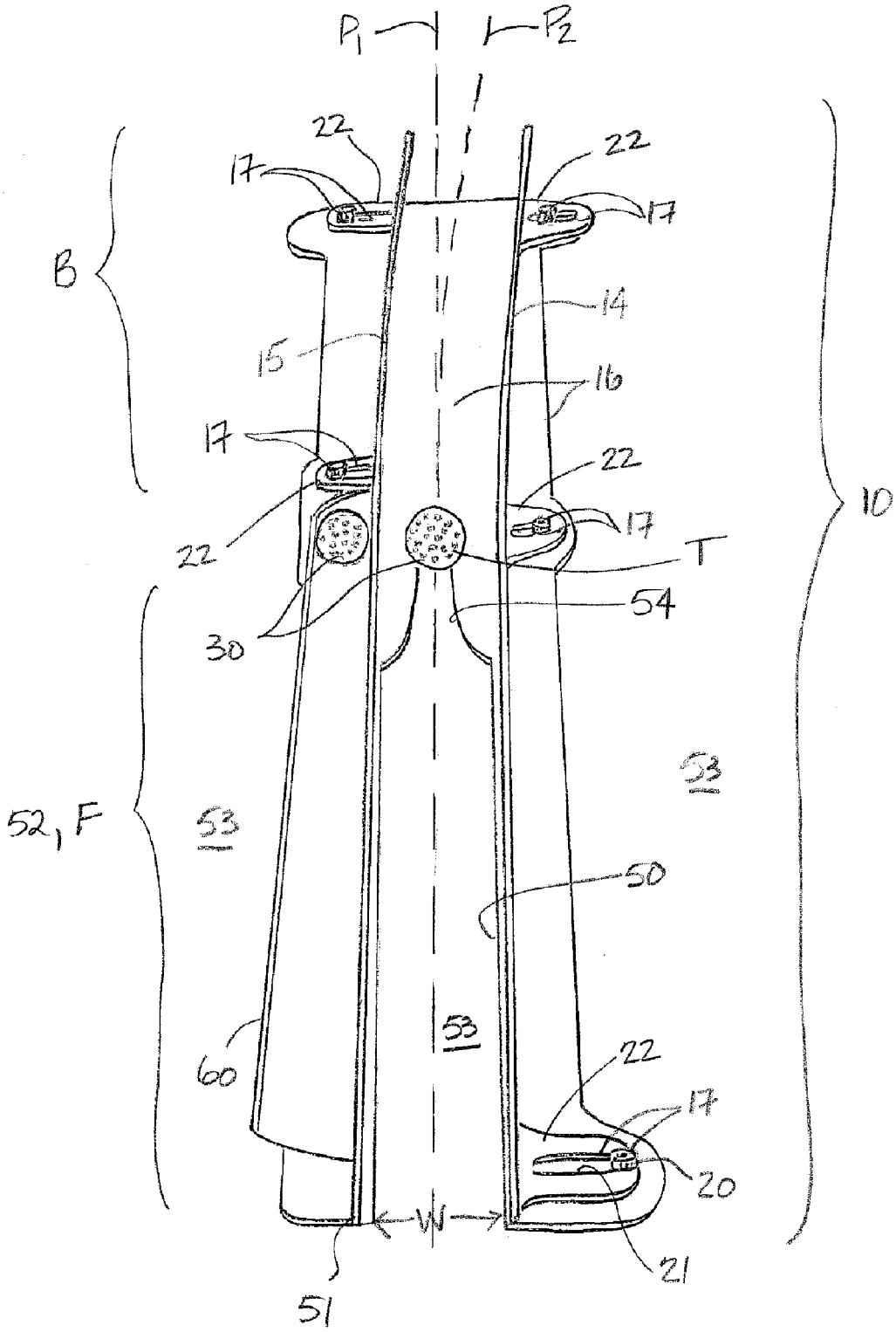
FIG. 2 is a perspective end view according to FIG. 1 having a portion of the track adjusted to permit an alternate curved backswing portion of the putting stroke.
Figure 3:
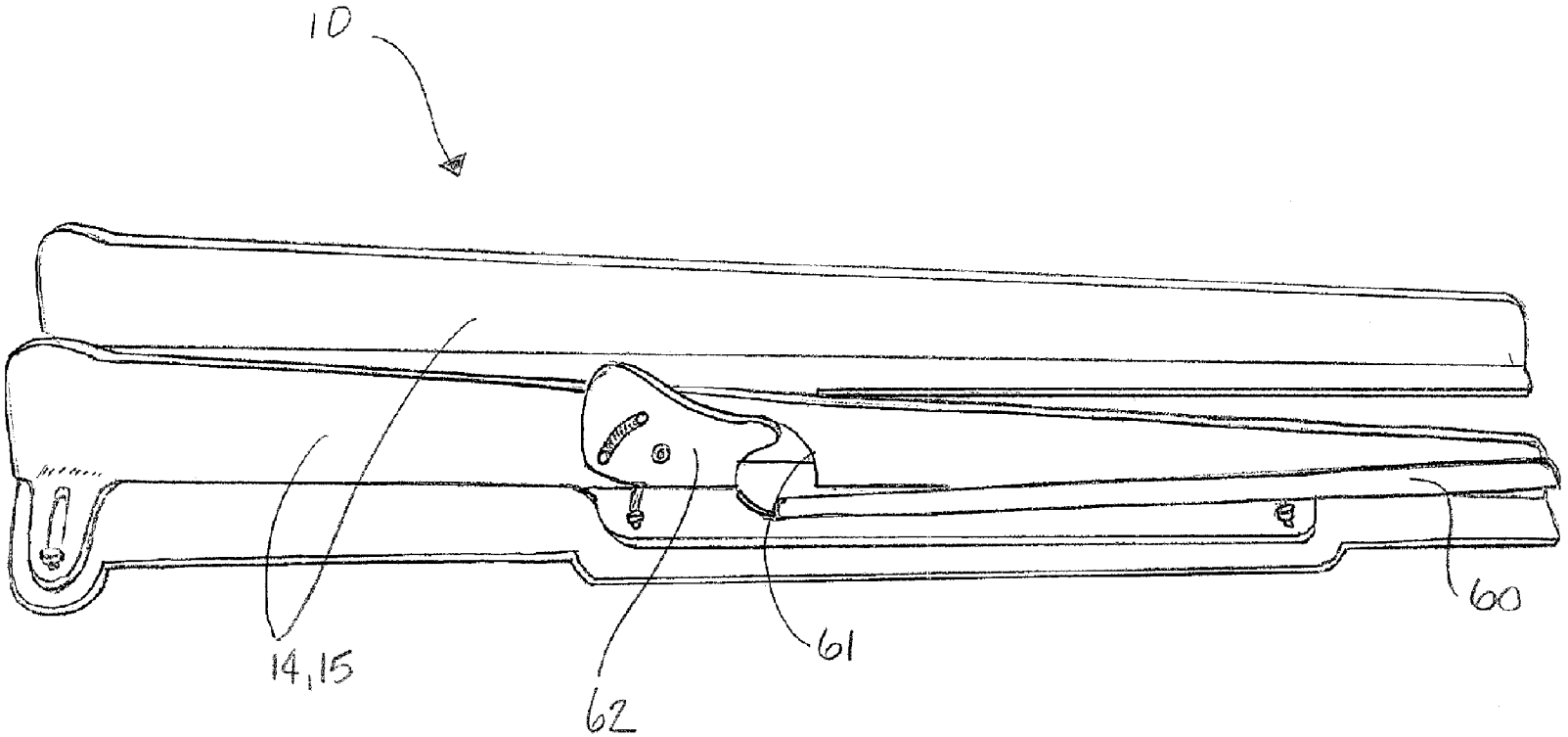
FIG. 3 is a side view according to FIG. 1 illustrating the ball supply trough and a user-actuated mechanism or gate means for feeding balls from the trough into the track.

As shown in FIG. 2 the track's path P may be adjusted for altering at least a portion of the putting stroke. Thus, golfers who may prefer a slightly curved backstroke over a straight backstroke, can move a portion B of the sidewalls 14, 15, while maintaining the parallel relationship therebetween, to create a curved backstroke P2 along a track 10 having a width W the same as that of the track 10 at a follow-through portion F of the stroke.

One embodiment of the guide 11 is shown in FIGS. 11–14. A protruding portion 40 of the guide 11 extends axially outward from an attachment portion 41 which attaches to the putter 13. Typically, the protruding portion 40 extends backwards, or lags from, the putter head 12. Alternatively, however, the guide 11 can be positioned so that the protruding portion 40 leads the putter head 12, provided the guide 11 is attached above a striking face (not shown) of the putter head 12, while still residing in the track 10 when the putter 13 is positioned therein.

In a preferred embodiment for use regardless whether the guide 11 lags or leads the putter head 12, the protruding portion 40 extends axially outwards from the putter 13 such that the protruding portion 40 is above the striking face (not shown) of the putter head 12 and typically above a height of a golf ball.

The width of the protruding portion 40 is substantially the same as the width W between the sidewalls of the track 10. Further, the extent to which the protruding portion 40 axially extends from the putter head 12 acts to increase an effective axial extent of the putter head 12, so that when the putter head 12 and guide 11 are positioned in the track 10 the putter head 12 cannot twist and bind within the track 10. Further, with each stroke of the putter 13 in the track 10 along the path P, a golfer is forced to maintain correct wrist position and build the necessary skill and muscle memory to reproduce the stroke without the track 10.

Figure 11:
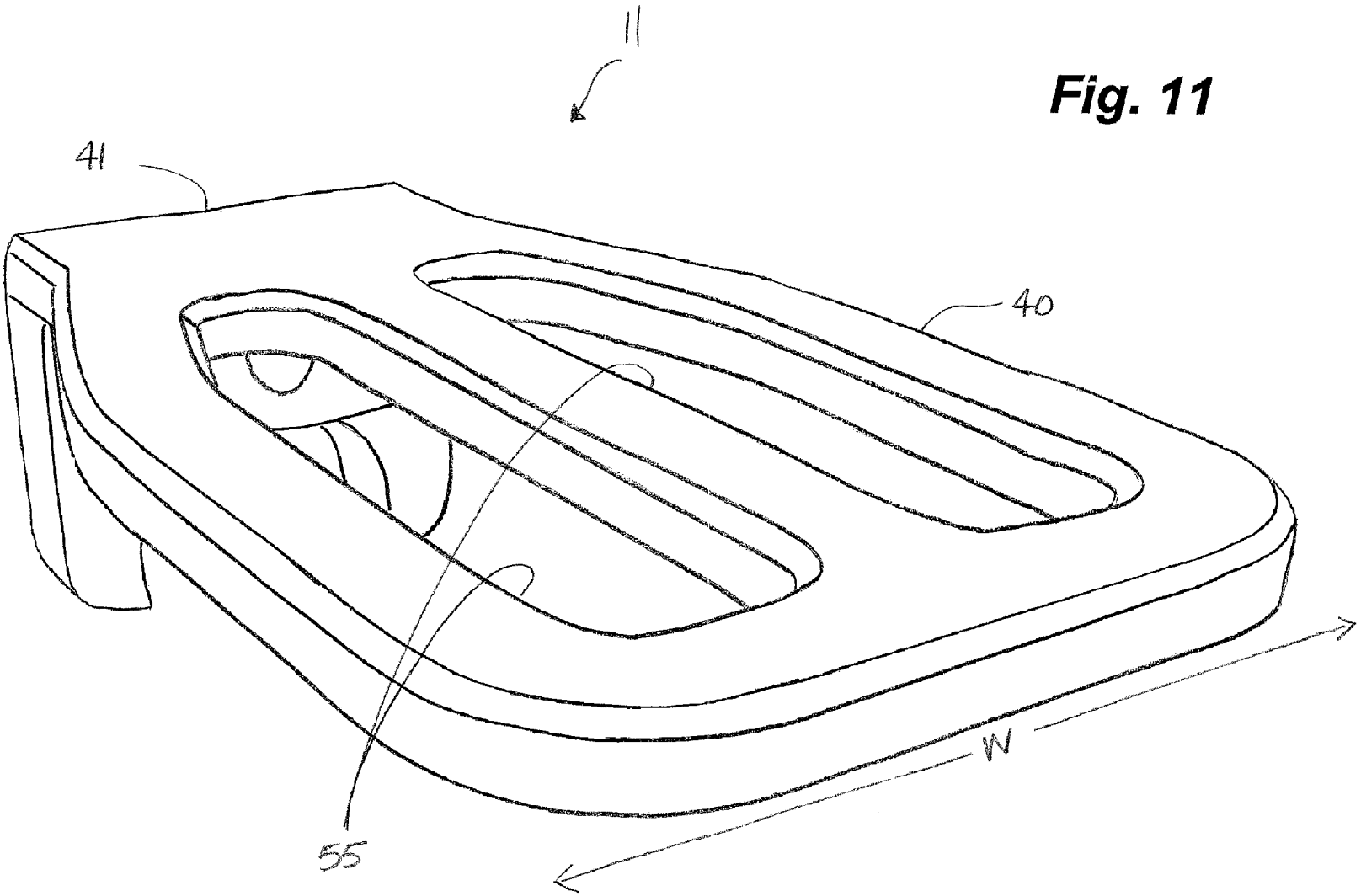
FIG. 11 is a rear perspective view of an embodiment of an embodiment of a guide adapted for attachment to a putter head having a rounded protrusion at a rear surface of the putter head.
Figure 12:
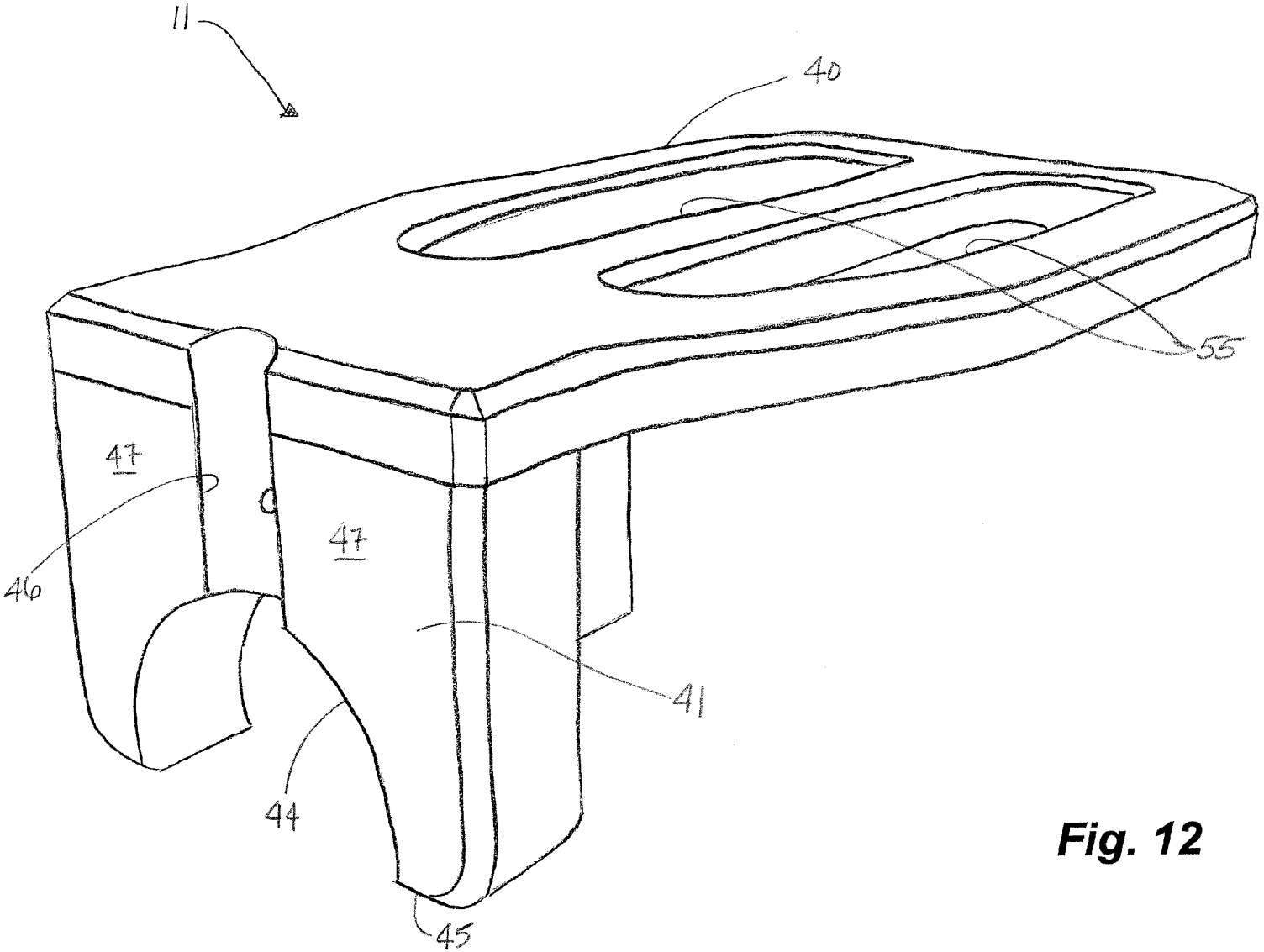
FIG. 12 is a front perspective view of the guide according to FIG. 11.
Figure 13:
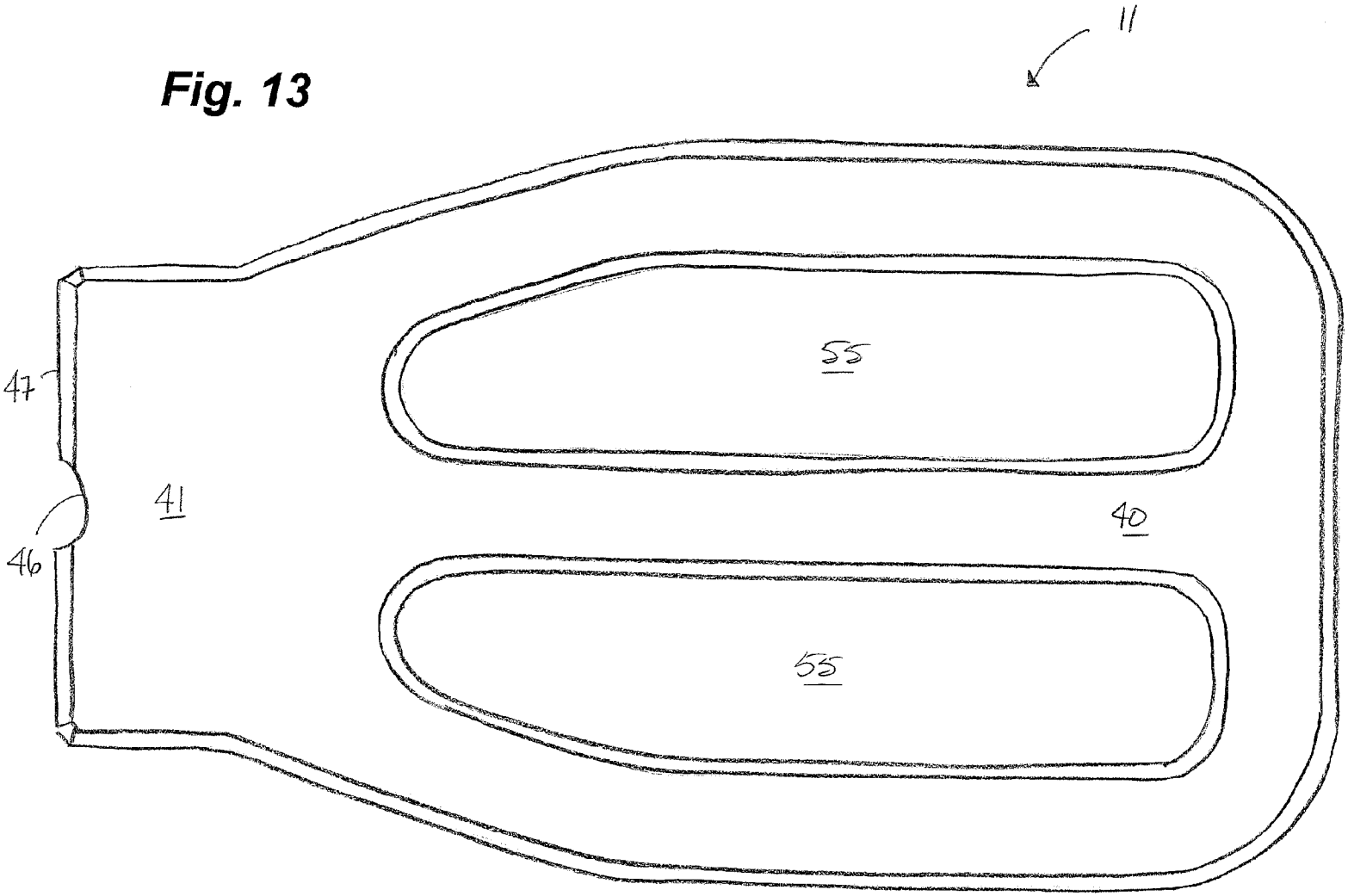
FIG. 13 is a plan view of the guide according to FIG. 11.
Figure 14:
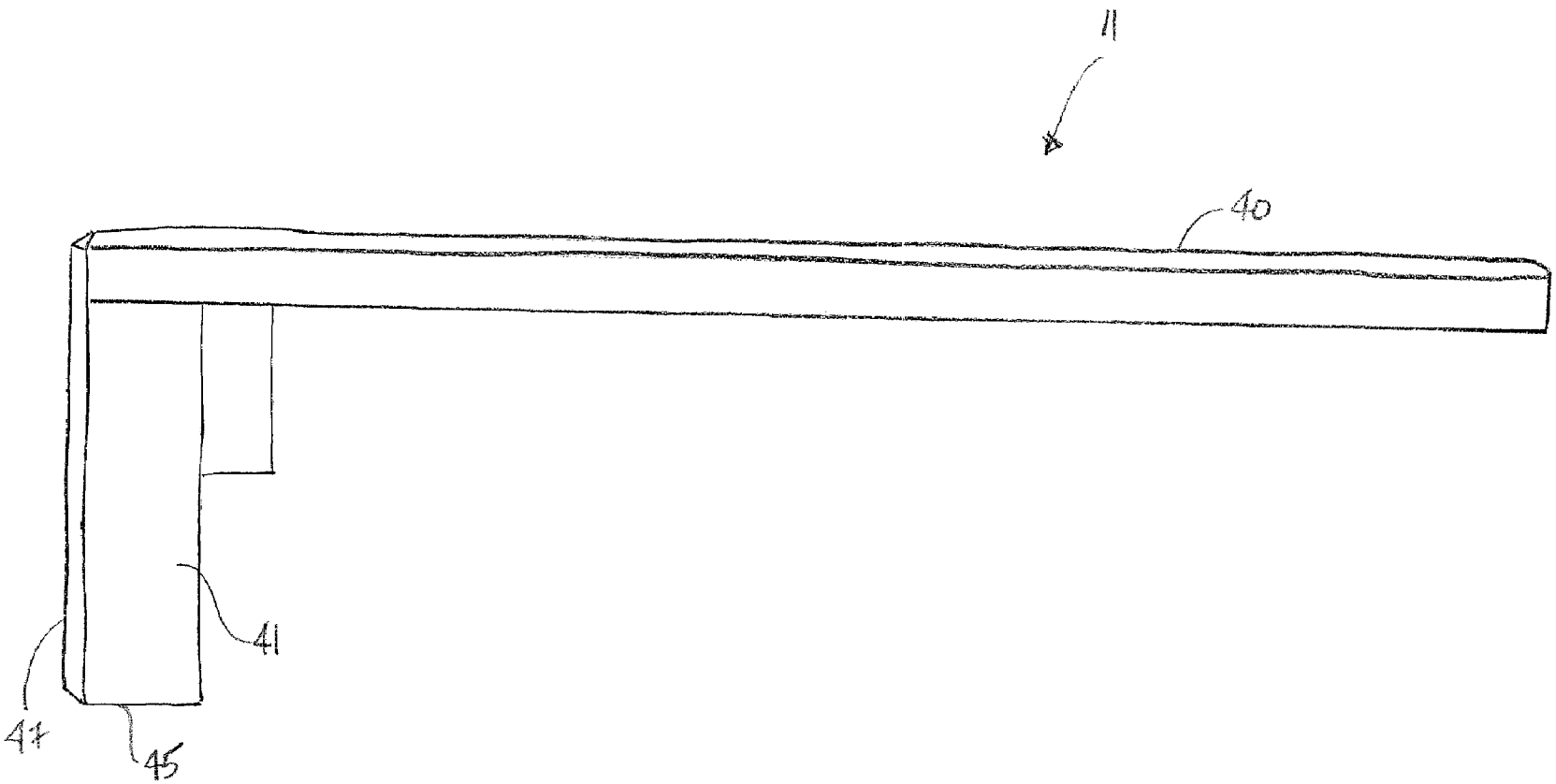
FIG. 14 is a side view of the guide according to FIG. 11.

As shown in FIGS. 1, 11 and 12 and in a particular embodiment of the guide 11 adapted for attachment to a putter 13 having a cylindrical putter head body 12*a* attached to a back surface 42 of a rectangular striking surface 43 (FIG. 1), a first groove 44 is formed in the bottom 45 of the attachment portion 41 of the guide 11 for co-operating with the cylindrical body 12*a* and retaining the guide 11 thereon. A second vertical groove 46 extends upwards from the first groove 44 along an end 47 of the attachment portion 41 to accommodate a hosel 48 which extends upwards from the head 12 and interconnects with a shaft 49. The second vertical groove 46 ensures that the guide 11 does not rotate about the cylindrical head 12 if the guide 11 contacts the sidewalls 14,15 of the track 10 during the stroke.

In a preferred embodiment, openings 55 are formed through the protruding portion 40 to allow the golfer to view at least a portion of the golf ball 30 and to reduce the weight of the guide 11.

One of skill in the art would understand that due to the variety in design of commercially available putters 13, a variety of means such as clips, grooves and the like may be provided for attachment of the guide 11 to various portions of the putter 13.

Typically, in use, the golfer positions the guide 11 on the putter 13 and then positions the putter head 12 and guide 11 between the sidewalls 14,15 of the track. The golfer then executes a putting stroke, causing the putter head 12 to be moved along the track as directed by the guide 11, the stroke passing through a target point T, typically a golf ball 30 positioned within the track 10. While the stroke may be completed without a ball 30 positioned in the track 10, the flight of the ball 30 from the track 10 provides additional visual feedback to the golfer. The golf ball 30 may be manually positioned in the track 10 by the golfer or may be supplied to the track 10 by supply means such as an automated or semi-automated ball supply.

Figure 9:
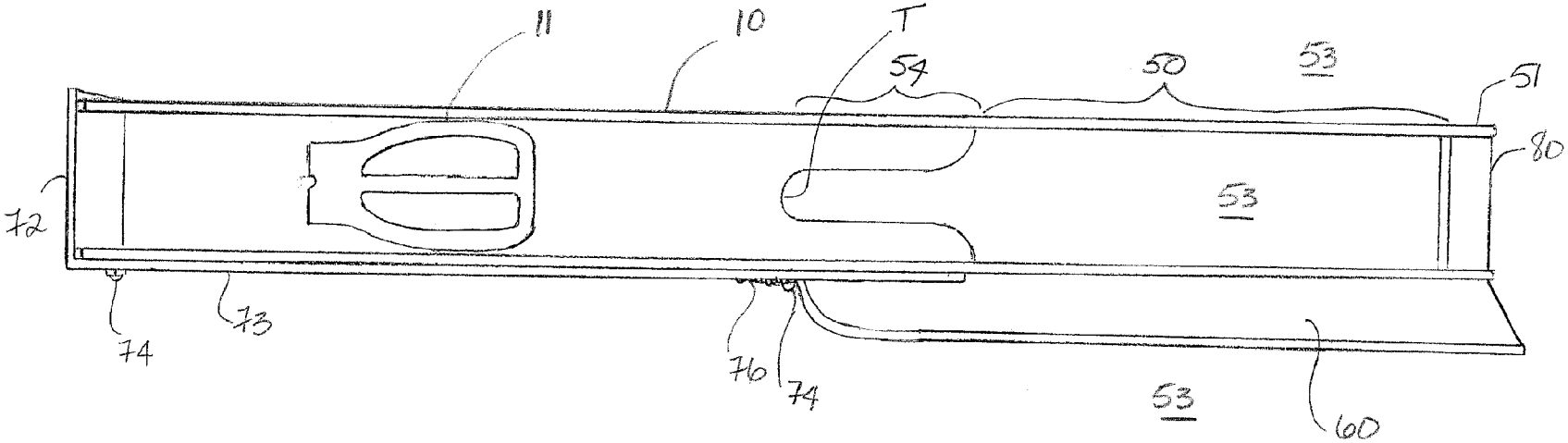
FIG. 9 is a plan view according to FIG. 6, illustrating an embodiment of a guide adapted for attachment to a putter head and sized to fit within the track, the guide shown for optionally leading the putter head.
Figure 10:
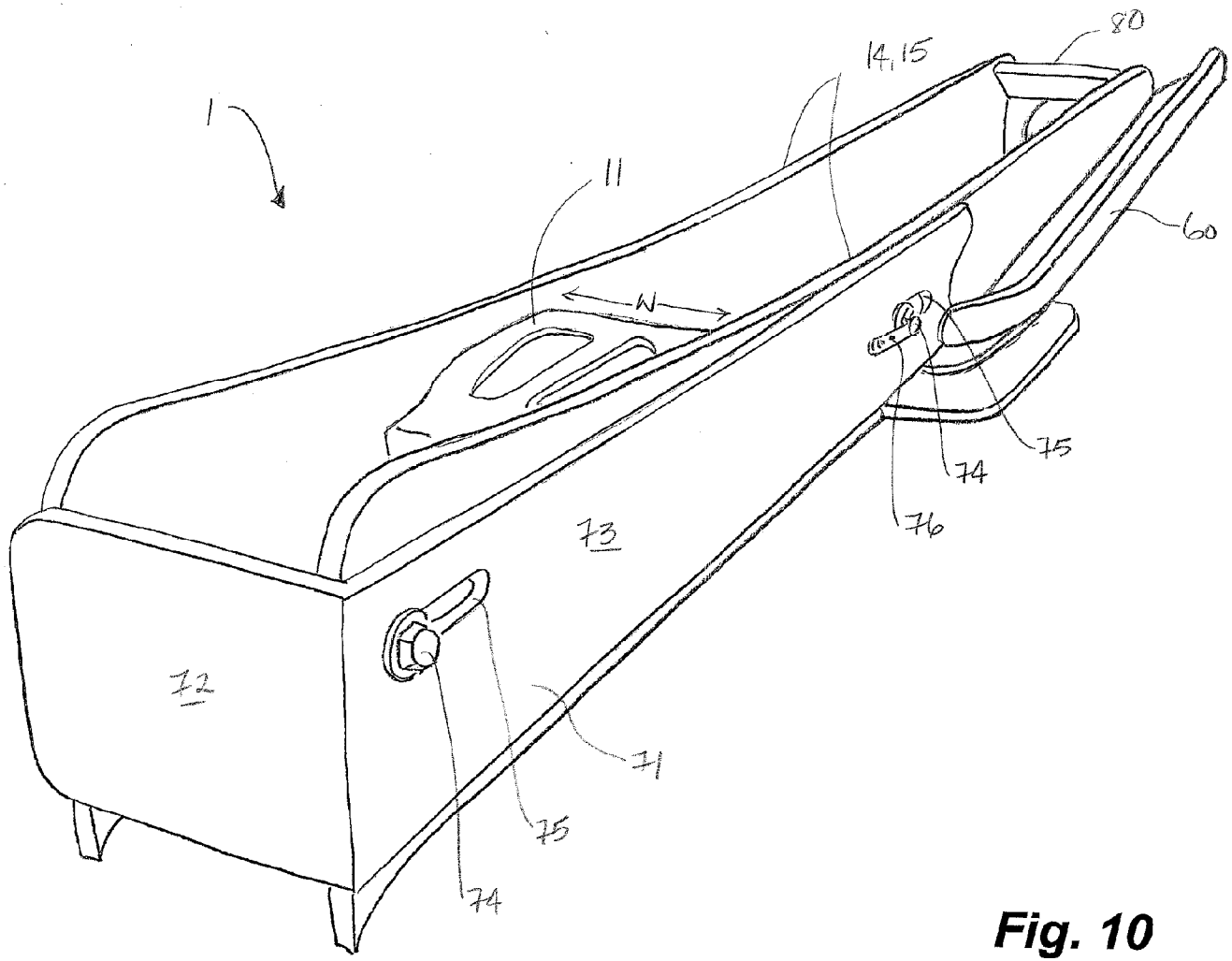
FIG. 10 is a perspective rear view illustrating the guide, according to FIG. 9, positioned in the track and leading the putter head, the putter having been removed for clarity.

Best seen in FIGS. 1, 2 and 9 and in a preferred embodiment, the base 16 further comprises an opening 50 which extends from a front end 51 of the base 16 for at least a portion 52 of the track 10 to permit the golf ball 30 to travel on a surface 53 on which the base 16 rests once it is struck by the putter head 12. Thus the flight of the ball 30 is not affected by transitions from the base 16 to the surface 53 which provides improved visual confirmation of the putting stroke to the golfer. More preferably, a narrow or restricted U-shaped opening 54 extends from the base opening 50 to aid in centering the golf ball 30 in the track 10.

Optionally, as shown in FIGS. 1–10, a ball supply means 60, typically a trough, is affixed to one of the sidewalls 14,15 for supplying golf balls 30 to the track 10. The trough 60 is angled downwards to an entrance 61 formed in the sidewall 14,15 so that balls 30 placed therein will roll downwards to the entrance 61. Preferably, a user-actuated ball feed mechanism or gate means 62 is positioned at the entrance 61 allowing the user to selectively permit the entrance of golf balls 30 to the track 10.

Figure 4:
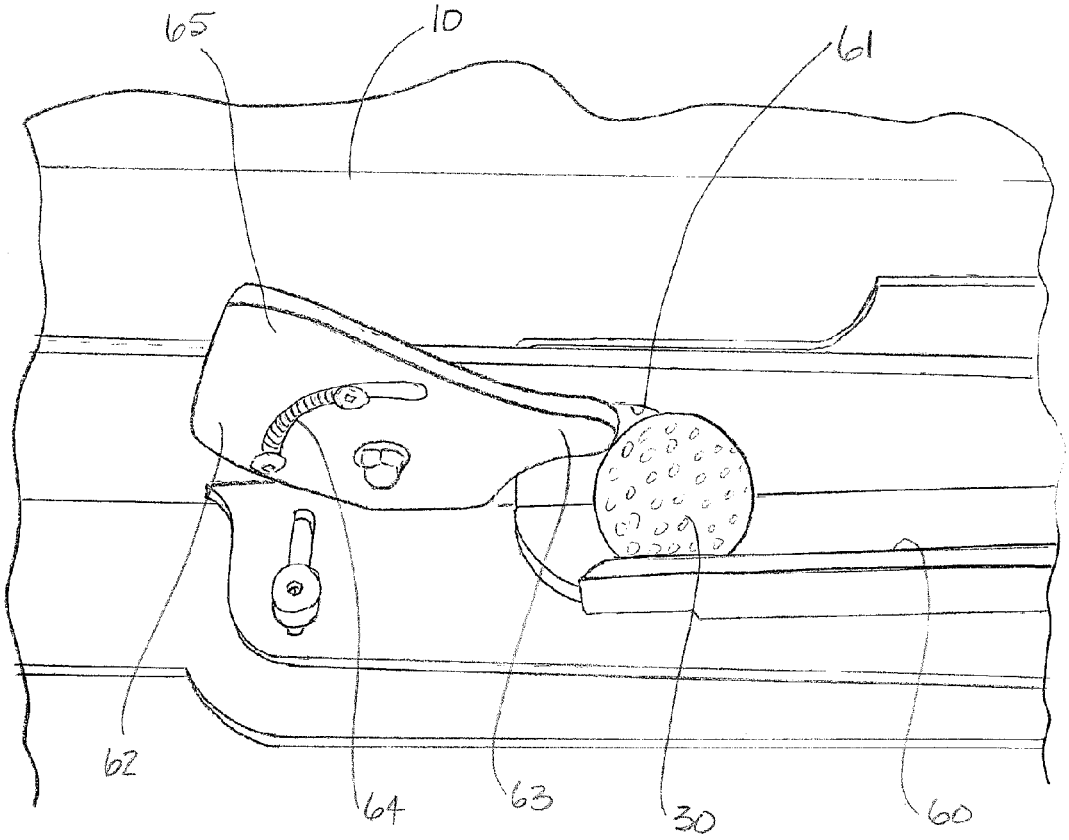
FIG. 4 is a close-up view of the gate means according to FIG. 3.
Figure 5:
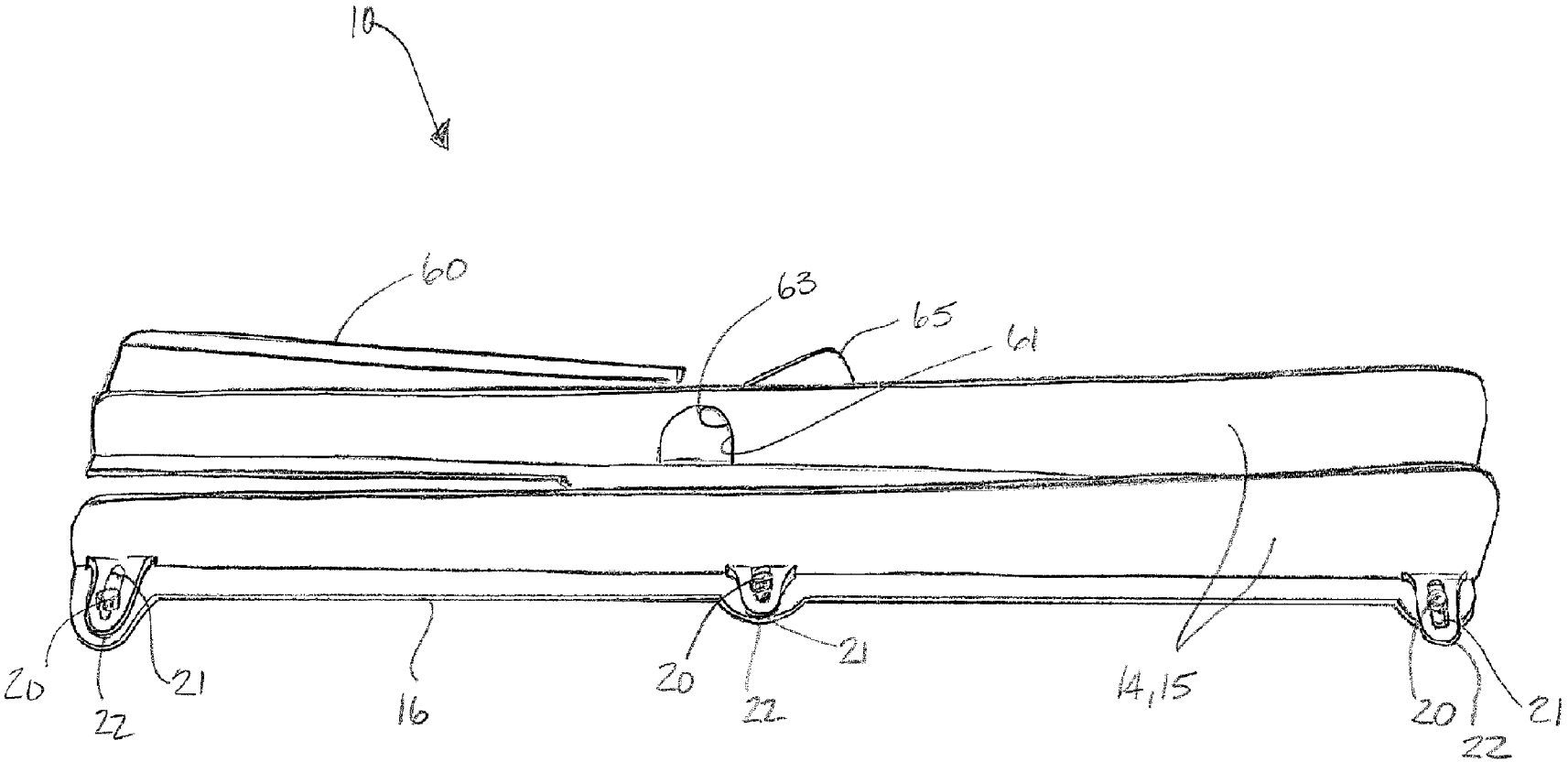
FIG. 5 is an perspective side view illustrating a plurality of adjustable connection means from an opposite side from that of FIG. 3.
Figure 6:
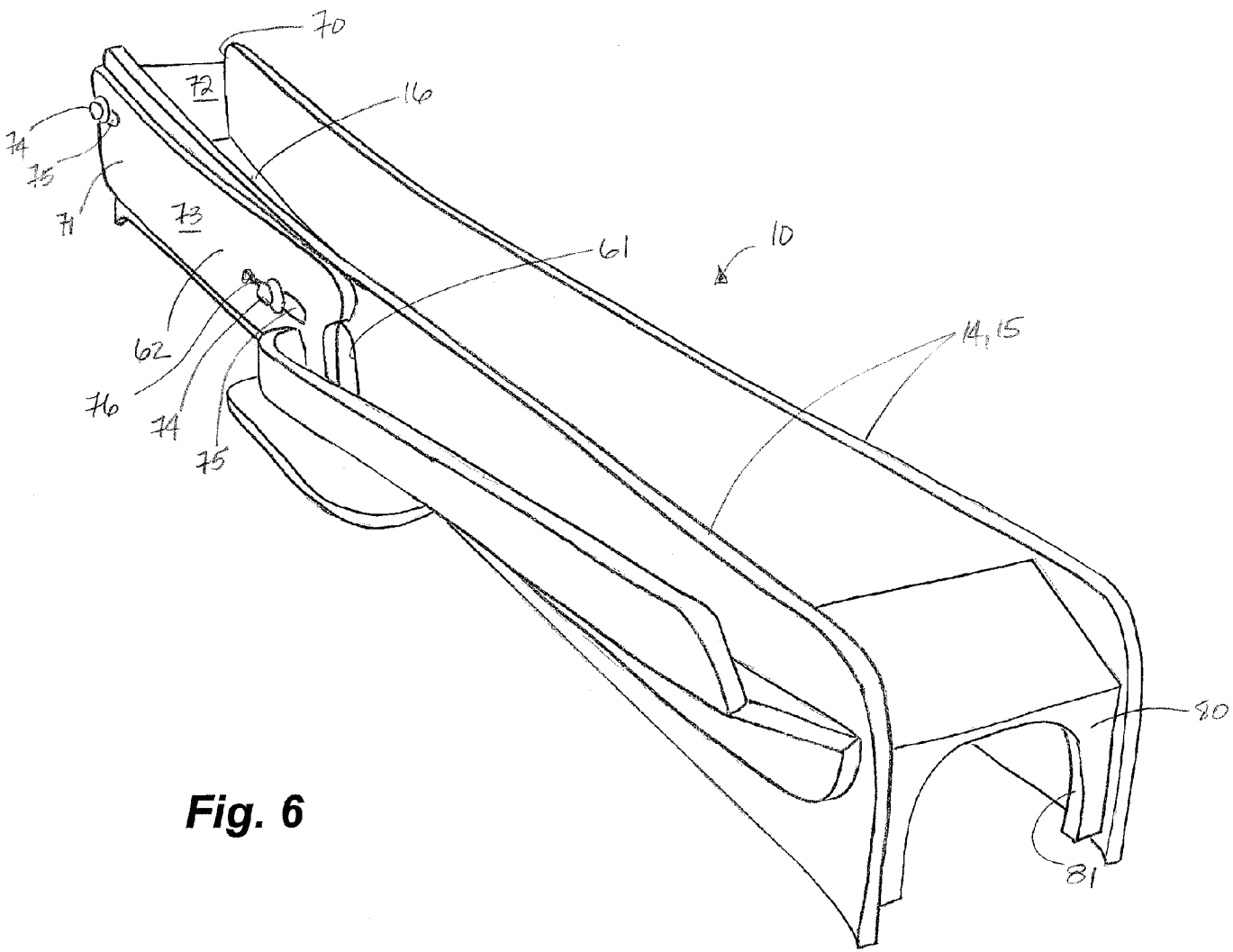
FIG. 6 is a perspective front view of an alternate embodiment of the invention having a fixed width track, and illustrating a ball feed trough and an alternate user-actuated mechanism to feed balls from the trough to the track.
Figure 7:
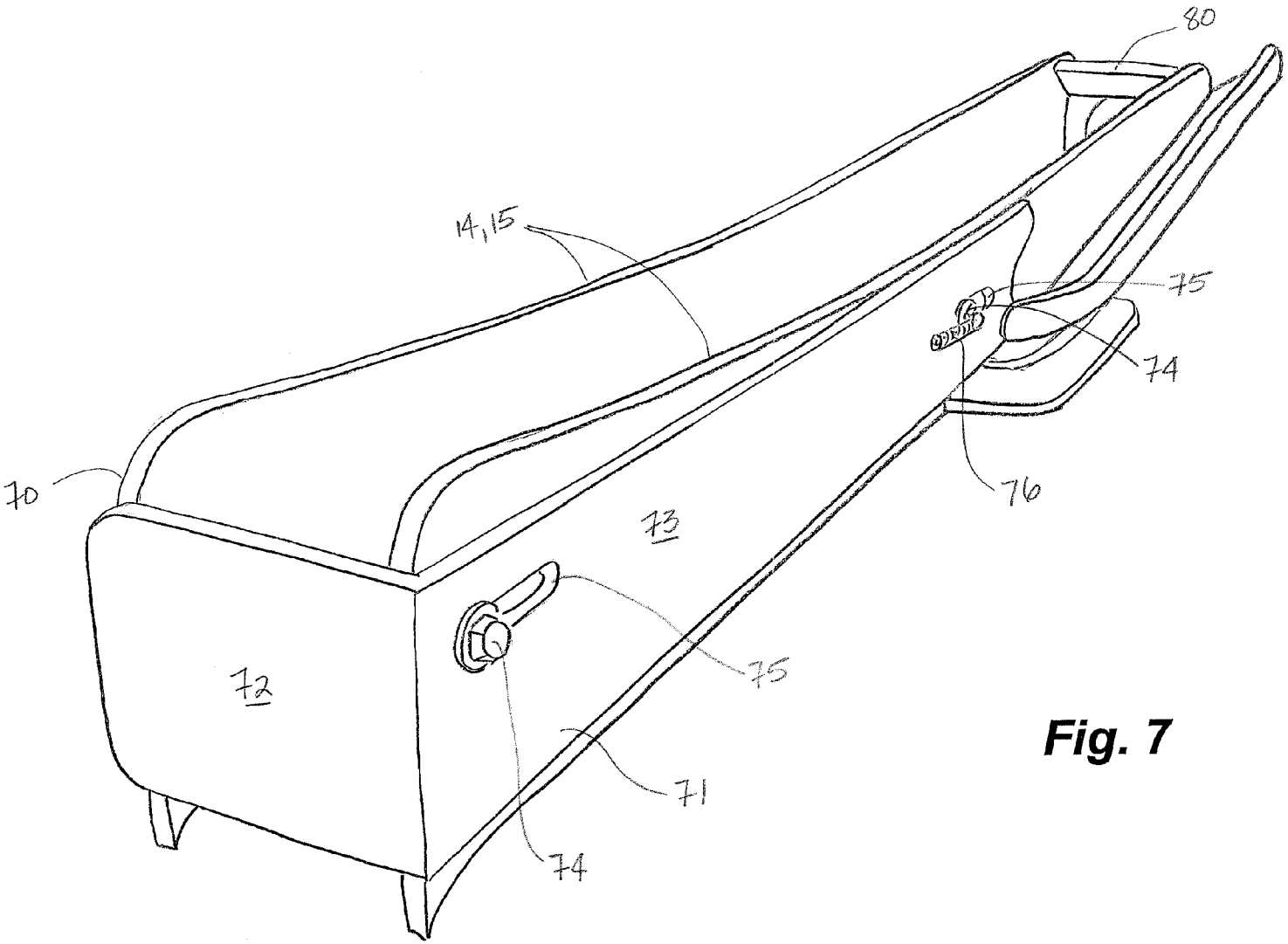
FIG. 7 is a perspective rear view according to FIG. 6.
Figure 8:
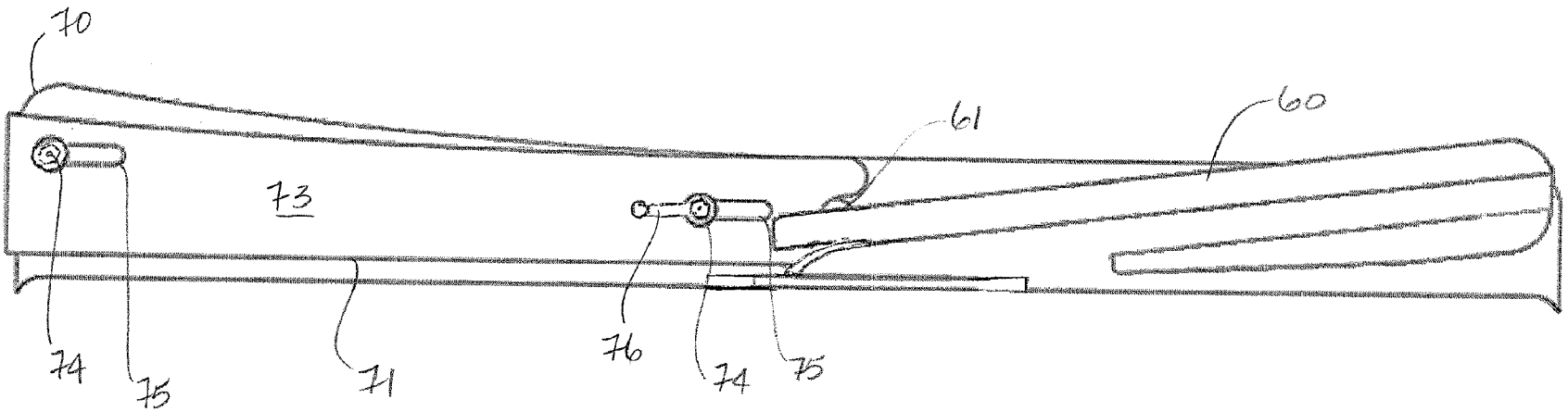
FIG. 8 is a side view according to FIG. 7.

Having reference to FIGS. 1–5 and best seen in FIG. 4, a preferred embodiment of the gate means 62 comprises a finger 63 pivotally connected to the track 10 and normally biased, such as by a spring 64, to protrude into the entrance 61 and prevent balls 30 from entering the track 10. When desired, the user actuates the finger 63 by applying pressure onto at least a portion of the finger 63, such as at an edge of a plate 65, extending from the finger 63 and above the sidewall 14,15, with the putter 13, to temporarily pivot the finger 63 away from the entrance 61 and allow a ball 30 to enter the track 10. Most preferably, the restricted U-shaped opening 54 terminates at the entrance 61 for accepting and centering balls 30 at target point T as the balls 30 are admitted to the track 10.

Having reference to FIGS. 6–10, another embodiment of the putting trainer 1 having a fixed width track wherein the substantially parallel sidewalls 14,15 are spaced apart fixed to the base 16, a corresponding guide and an alternate gate means 62, is shown. An end 70 of the track 10, adjacent the completion of the backswing portion of the putting stroke, is covered by an L-shaped plate 71 which extends over the track's end 70 and along a sidewall 14 of the track 10 to protrude across at least a portion of the entrance 61 forming an end wall 72 and gate 73. The L-shaped plate 71 is moveably connected to the sidewall 14 by co-operating fasteners 74 and slots 75 and is biased to a normally closed position wherein the end wall 72 abuts the sidewalls 14,15 and the gate protrudes into the entrance 61. Extensible biasing means 76, such as an elastic band or spring, is connected between the fasteners 74 for biasing the L-shaped plate 71 to the closed position. The user actuates the L-shaped plate 71 to move away from the entrance 61 and permit a ball 30 to enter the track, by moving the putter head 12 and guide 11 to the furthest axial extent of the backswing portion of the track 10 and applying pressure on the end wall 72. The pressure overcomes the biasing means 76 and causes the end wall 72 to move away from the sidewalls 14,15 and pulls the gate 73 away from the entrance 61.

Additionally, a front wall 80 may extend between the sidewalls 14,15. An exit opening 81 is formed in the front wall 80 to permit the golf ball 30 to exit the track below the wall 80 when struck by the putter head 12. The front wall 80 may aid in providing structural rigidity to the fixed width track 10.

What is claimed is:

1. Apparatus for training a golfing stroke using a putter comprising:

a base;

substantially parallel sidewalls connected to the base and spaced a width apart for forming a track defining a path therebetween, the track adapted for freely accepting a putter head into and out of the track for freely moving therein along the path; and a guide adapted to be releasably connected to the putter to freely reside and extend axially in the track and sized to be substantially the width between the sidewalls and to extend an effective axial extent from the putter head sufficient to prevent binding of the putter head and guide within the track, when stroked, the putter and the guide being freely moveable into and out of the track, wherein, in the track, the guide maintains the putter head substantially perpendicular to the sidewalls and directs the putter head axially therein when moved along the path for stroking through a target point.

2. The apparatus as described in claim 1 wherein the guide lags axially to extend behind the putter head.

3. The apparatus as described in claim 1 wherein the guide is connected to the putter head above a striking face and the guide leads axially to extend ahead of the putter head.

4. The apparatus as described in claim 1 wherein the target point is a golf ball positioned in the track.

5. The apparatus as described in claim 1 wherein the base further comprises an opening extending from a front end of the base and along at least a portion of the track and adapted for positioning the golf ball on a surface on which the base rests.

6. The apparatus as described in claim 5 wherein the base opening further comprises a restricted U-shaped opening contiguous with the base opening for centering the golf ball in the track.

7. The apparatus as described in claim 1 further comprising means for providing a supply of golf balls to the track.

8. The apparatus as described in claim 7 wherein the means for providing the supply of golf balls to the track is an angled, ramped trough positioned adjacent one of the sidewalls and further comprising:

an entrance connected between the trough and the sidewall for permitting release of golf balls from the trough to the track; and a gate connected to the entrance for actuating the gate between an open position wherein a golf ball is permitted to enter the track through the entrance and a closed position wherein the entrance is blocked.

9. The apparatus as described in claim 8 wherein the gate is a finger pivotally connected to the sidewall by biasing means and normally biased to the closed position for blocking at least a portion of the entrance and wherein the finger is actuable to the open position by pressure applied to at least a portion of the finger to overcome the biasing means and temporarily pivot the finger to the open position.

10. The apparatus as described in claim 8 further comprising an opening extending from a front end of the base and for at least a portion of the track adapted for positioning the golf ball on a surface on which the base rests, wherein the base opening extends to at least the opening in the sidewall.

11. The apparatus as described in claim 10 further comprising a restricted U-shaped opening contiguous with the base opening wherein the U-shaped opening terminates adjacent the entrance in the sidewall for receiving and centering the golf ball in the track.

12. The apparatus as described in claim 1 wherein the substantially parallel sidewalls are adjustably connected to the base for altering the track.

13. The apparatus as described in claim 12 further comprising a plurality of adjustable connection means for adjustably connecting each sidewall to the base.

14. The apparatus as described in claim 13 wherein at least some of the plurality of connection means are adjusted for moving at least one of the sidewalls relative to the base for altering the width of the track.

15. The apparatus as described in claim 13 wherein at least some of the plurality of connection means are adjusted relative to the remainder of the connection means and at least a portion of each of the sidewalls can be moved relative to the base for altering the path of the track.

16. The apparatus as described in claim 13 wherein the adjustable connection means are co-operating fasteners and slots.

17. The apparatus as described in claim 1 wherein the guide extends an effective axial extent from the putter head sufficient to prevent binding of the putter head and guide, within the track, when stroked.

18. The apparatus as described in claim 1 further comprising a ball supply for supplying golf balls to the track.

19. The apparatus as described in claim 18 wherein the ball supply is an angled, ramped trough positioned adjacent one of the sidewalls and further comprising:

an entrance connected between the trough and the sidewall for permitting release of golf balls from the trough to the track; and a gate connected to the entrance for actuating the gate between an open position wherein a golf ball is permitted to enter the track through the entrance and a closed position wherein the entrance is blocked.

20. The apparatus as described in claim 19 wherein the gate is a finger pivotally connected to the sidewall by biasing means and normally biased to the closed position for blocking at least a portion of the entrance and wherein the finger is actuable to the open position by pressure applied to at least a portion of the finger to overcome the biasing means and temporarily pivot the finger to the open position.

21. The apparatus as described in claim 18 further comprising an opening extending from a front end of the base and for at least a portion of the track adapted for positioning the golf ball on a surface on which the base rests, wherein the base opening extends to at least the opening in the sidewall.

22. The apparatus as described in claim 21 further comprising a restricted U-shaped opening contiguous with the base opening wherein the U-shaped opening contiguous with the base opening wherein the U-shaped opening terminates adjacent the entrance in the sidewall for receiving and centering the golf ball in the track.

* * * * *